United States Patent [19]

Schmidt

[11] Patent Number: 4,951,434

[45] Date of Patent: Aug. 28, 1990

[54] PRE-FORMED STAIR CONSTRUCTION

[76] Inventor: George A. Schmidt, 1852 Kirby Rd., Glendale, Calif. 91208

[21] Appl. No.: 320,547

[22] Filed: Mar. 7, 1989

[51] Int. Cl.[5] ..... E04F 11/00

[52] U.S. Cl. ..... 52/191; 52/185; 52/190

[58] Field of Search ..... 52/182–191, 52/169.7; 182/83, 185

[56] References Cited

U.S. PATENT DOCUMENTS

| | | | |
|---|---|---|---|
| 1,343,739 | 6/1920 | Nesdall | 52/191 |
| 2,471,352 | 5/1949 | Safir | 52/191 |
| 2,615,325 | 10/1952 | Seeber | 52/190 |
| 3,021,928 | 2/1962 | Blair | 52/191 |
| 3,720,024 | 3/1973 | Theisen | 52/185 |
| 3,805,464 | 4/1974 | Hanson | 52/190 |
| 3,978,628 | 9/1976 | Turner | 52/190 X |
| 4,041,662 | 8/1977 | Ward | 52/187 |
| 4,343,120 | 8/1982 | Witte | 52/169.7 X |

FOREIGN PATENT DOCUMENTS

| | | | |
|---|---|---|---|
| 29471 | of 1910 | United Kingdom | 52/191 |

*Primary Examiner*—Richard E. Chilcot, Jr.
*Attorney, Agent, or Firm*—Robert M. Sperry

[57] ABSTRACT

A prefabricated stairway formed of a plurality of pre-formed steps composed of wear-resistant plastic or composite material which can be injection molded in units of one or more steps to permit inexpensive mass production and which are simple and inexpensive to install and can be formed of colored material to provide a highly aesthetic appearance.

15 Claims, 5 Drawing Sheets

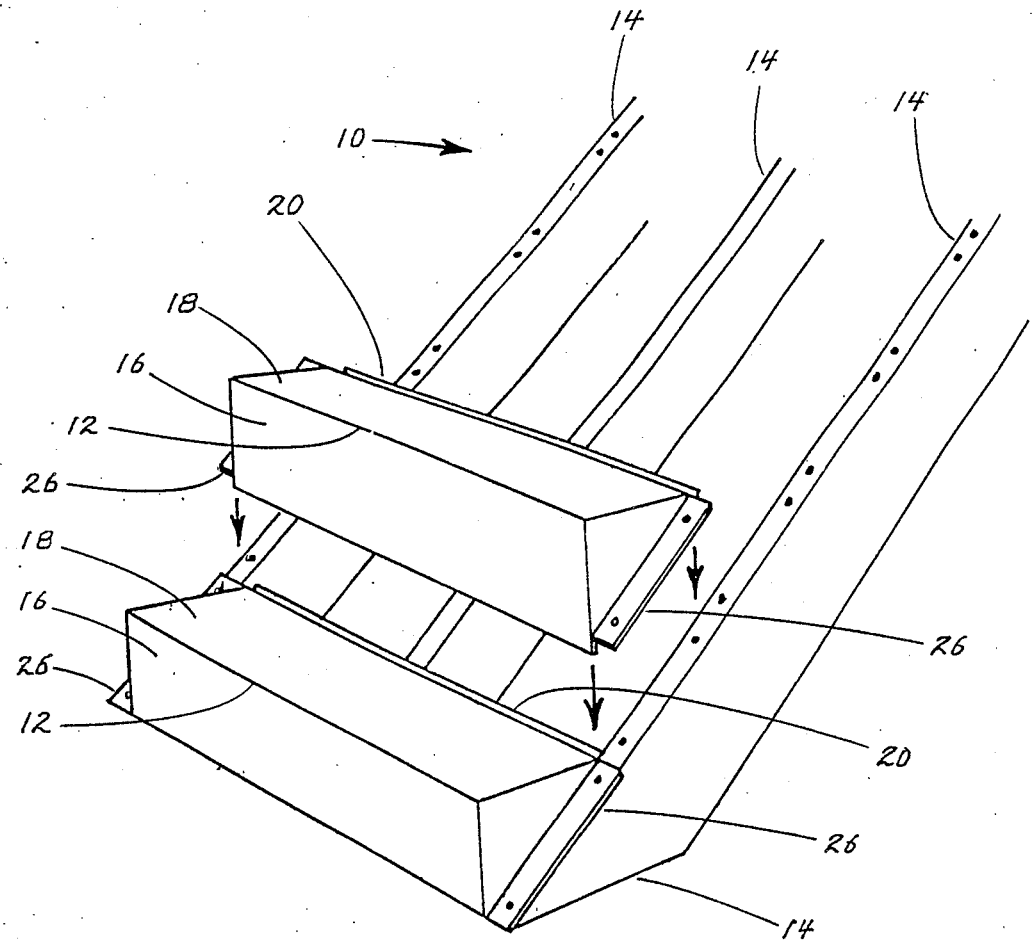
FIG I

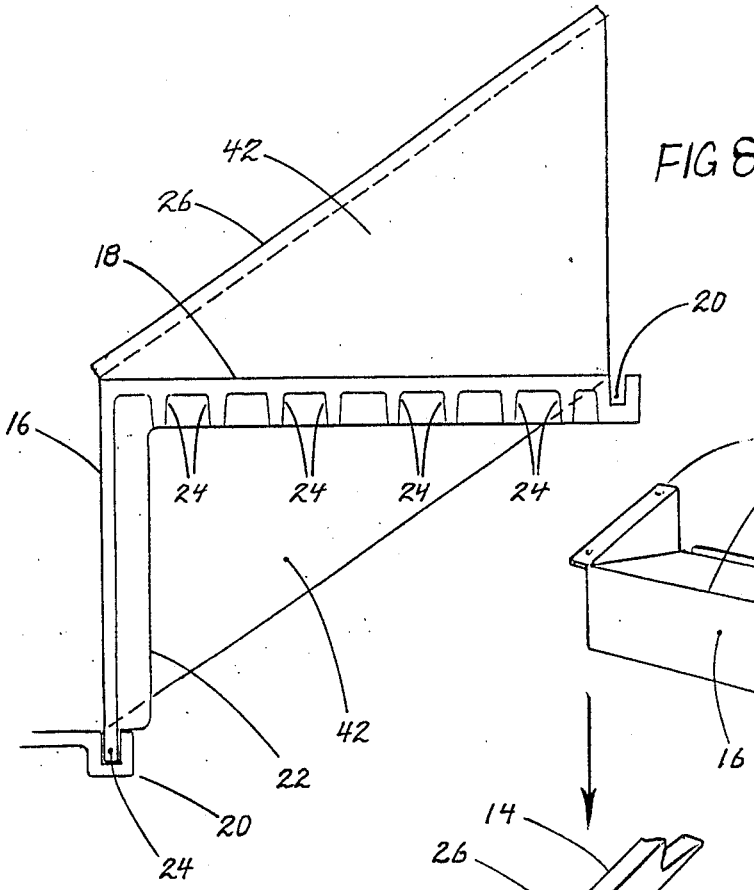
FIG 8
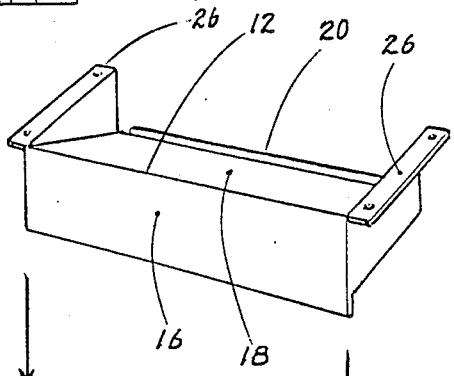
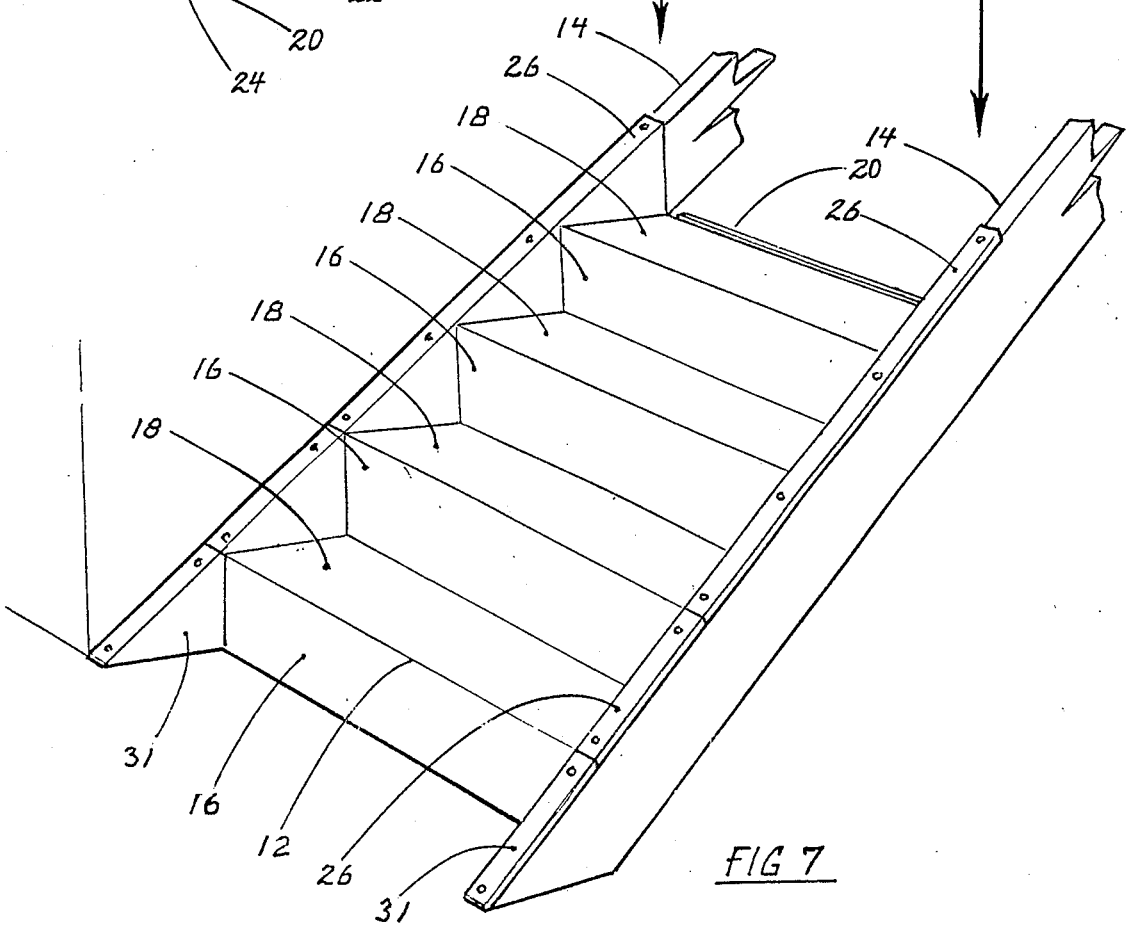
FIG 7

PRE-FORMED STAIR CONSTRUCTION

BACKGROUND

1. Field of Invention

This invention relates to stair construction and is particularly directed to pre-formed stair construction for facilitating installation of stairways in buildings and the like.

2. Prior Art

In the construction of buildings, the installation of stairways is a labor intensive and time consuming operation which adds substantially to the ultimate cost of the building. A conventional thirteen step stair, as found in most houses, requires two full man days to erect using conventional carpentry methods. To reduce the time and cost involved in installing stairways, prefabricated stairways have been proposed. However, many of the prior art prefabricated stairways are unsightly and many are unsafe, while others are so expensive to produce and install that the ultimate cost is equal to or greater than the cost of stairways constructed by carpenters. Thus, none of the prefabricated stairways of the prior art have been entirely satisfactory.

A search in the United States Patent Office has revealed the following references:

| U.S. PAT. NO. | INVENTOR | ISSUED |
|---|---|---|
| 3,474,882 | H. Ernst | Oct. 28, 1960 |
| 4,583,334 | R. M. Hubbard | Apr. 22, 1986 |
| 4,583,335 | F. Morellini | Apr. 22, 1986 |
| 4,706,425 | J. J. Brumbalough | Nov. 17, 1987 |

The prefabricated stairways of Morellini and Brumbalough are complex and would be extremely expensive to produce and install, while the stairways of Erst and Hubbard are unsightly and do little to relieve the labor required for installation.

BRIEF SUMMARY AND OBJECTS OF INVENTION

The disadvantages of the prior art are overcome with the present invention and an improved prefabricated stairway is proposed which is extremely simple and inexpensive to produce and install, yet which is very flexible in application and is aesthetically pleasing as well.

These advantages of the present invention are preferably attained by providing a prefabricated stairway formed of a plurality of preformed steps composed of wear-resistant plastic or composite material which can be injection molded in units of one or more steps to permit inexpensive mass production and which are simple and inexpensive to install and can be formed of colored material to provide a highly aesthetic appearance.

Accordingly, it is an object of the present invention to provide improved prefabricated stairways.

Another object of the present invention is to provide prefabricated stairways formed of plastic or composite material which can be injection molded.

A further object of the present invention is to provide prefabricated stairways which can be mass produced and are simple and inexpensive to install.

An additional object of the present invention is to provide prefabricated stairways which can be injection molded of colored material to provide an aesthetic appearance.

A specific object of the present invention is to provide a prefabricated stairway formed of a plurality of preformed steps composed of wear-resistant plastic or composite material which can be injection molded in units of one or more steps to permit inexpensive mass production and which are simple and inexpensive to install and can be formed of colored material to provide a highly aesthetic appearance.

These and other objects and features of the present invention will be apparent from the following detailed description, taken with reference to the figures of the accompanying drawings.

BRIEF DESCRIPTION OF THE DRAWINGS

FIG. 1 is an isometric view showing a stairway embodying the present invention;

FIG. 7 is an isometric view of an additional alternative form of the step of FIG. 2; and FIG. 8 is a vertical section through the step of FIG. 7.

DETAILED DESCRIPTION OF THE INVENTION

In that form of the present invention chosen for purposes of illustration in FIG. 1, a stairway, indicated generally at 10, is shown comprising a plurality of steps 12 mounted on a plurality of stringers 14. As is well known, the stringers 14 extend from the lower level to the upper level and serve to support the steps 12 of the stairway 10. The stringers 14 are normally formed of 2"×8" wooden boards. However, in accordance with the present invention, the stringers 14 may be injection molded of strong plastic or composite material, such as carbon fibers, expanded polypropylene foam or the like. This also permits the stringers 14 to be preformed to fit the contour of the steps 12, as seen in FIG. 6. The steps 12 are also injection molded of similar material and may be formed individually, as seen in FIGS. 1, 2, 4 and 5, or may be formed in multiple units, as seen in FIGS. 6 and 7. It will be understood that in the injection molding process, the steps 12 may be provided with a woodgrain pattern or may be colored substantially as desired to compliment or contrast with the decor of the building.

Figure 2:
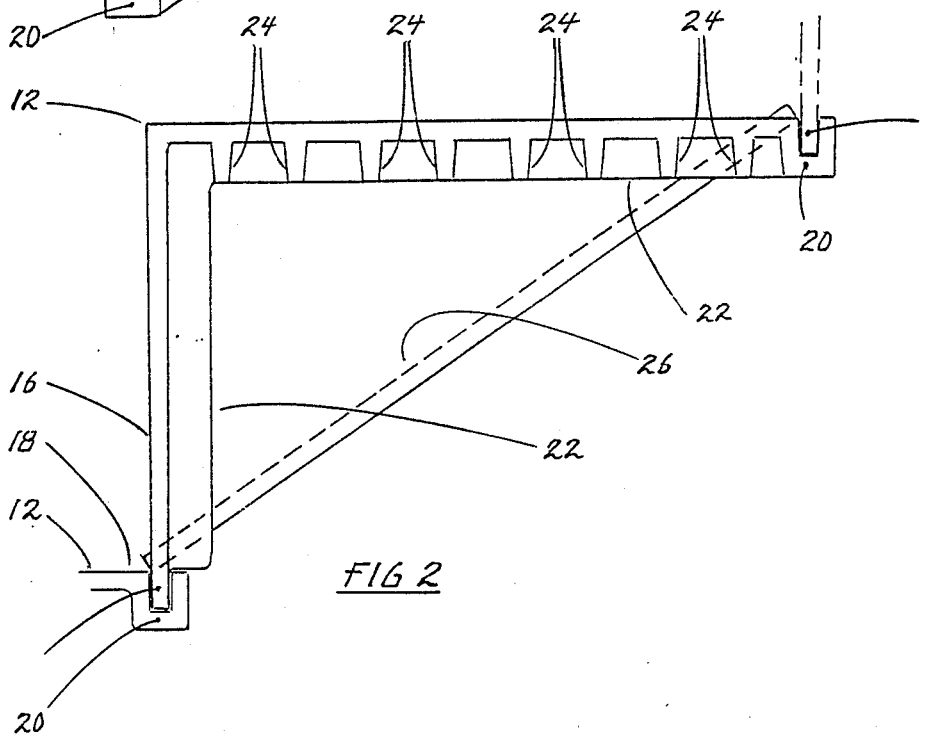
FIG. 2 is a vertical section through one step of the stairway of FIG. 1.
Figure 3:
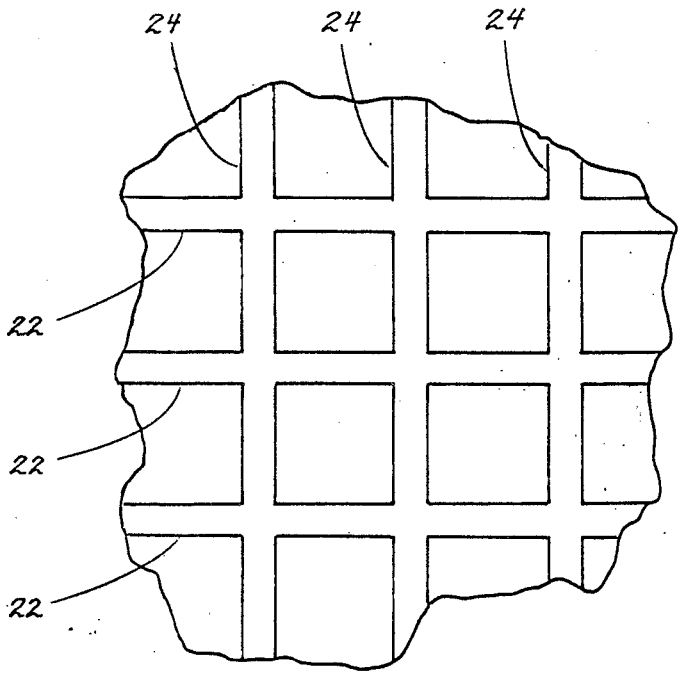
FIG. 3 is a bottom view of the step of FIG. 2.

As seen in FIG. 2, the step 12 is formed with a riser portion 16 which extends vertically upward and a horizontal tread portion 18 which terminates in a generally U-shaped channel 20 extending the full width of the step 12. As best seen in FIG. 3, the underside of the tread portion 18 of the step 12 may, if desired, be formed with a plurality of supporting ribs 22 which extend crosswise of the step 12 and additional supporting ribs 24 which extend lengthwise of the step 12 or, as seen in FIG. 3 the supporting ribs 22 and 24 may form a grid. Also, if desired, the supporting ribs 22 and 24 may be provided on the riser portion 16 as well. As seen in FIG. 1, each of the steps 12 is also provided with lateral flanges 26 projecting from each end of the step 12 and running diagonally from the bottom of the riser portion 16 to the rear end of the tread portion 18.

In use, the stringers 14 are installed in a conventional manner, regardless of whether the stringers 14 are wooden or injection molded. Thereafter, the steps 12 are installed by simply placing each step 12 on the stringers 14 and nailing through premolded nail holes in the flanges 26 to secure the step 12 to the stringers 14. In placing the step 12 on the stringers 14, the lower edge of the riser portion 16 of the lowermost step 12 is trimmed to proper height and is placed on the floor of the lower level. Alternatively, a separate mold could be provided for the lower step. Thereafter, the lower edge of the riser portion 16 of each successive step 12 is inserted into the U-shaped channel 20 at the rear of the tread portion 18 of the preceding step 12. Thus, the steps 12 are interlocked and serve to form an substantially integral unit defining the stairway 10. In this way, an individual carpenter can quickly and easily install a stairway in a minimum of time and without requiring assistance. This greatly reduces the time and cost of installing stairways.

Figure 4:
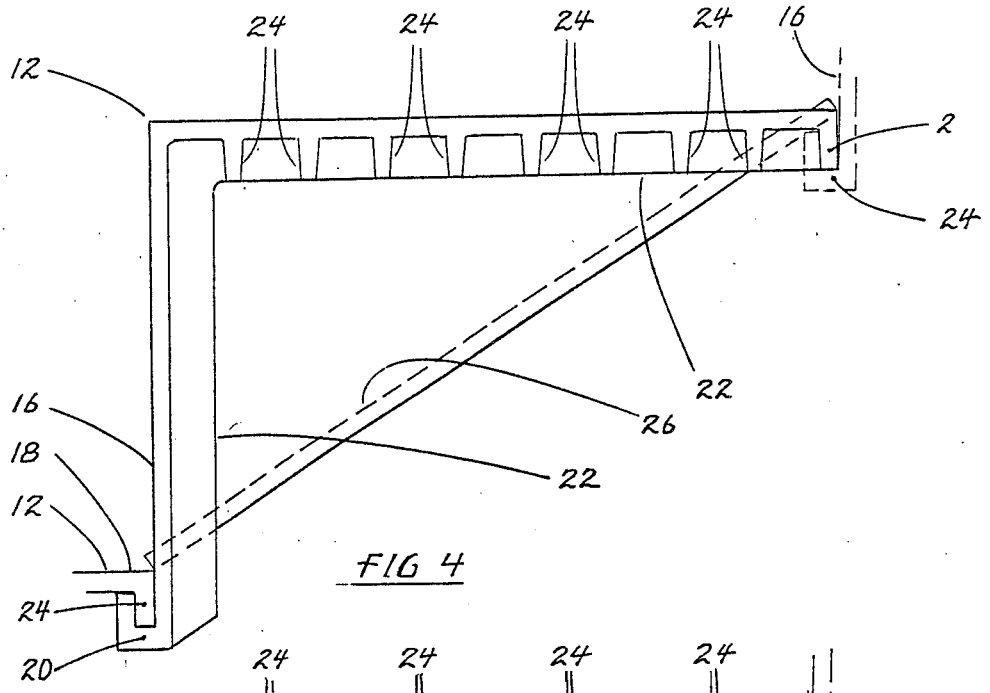
FIG. 4 is a vertical section through an alternative form of the step of FIG. 2.

FIG. 4 shows an alternative form of the step 12 for use in forming the stairway 10 of FIG. 1. In this form, the U-shaped channel 20 is provided on the lower edge of the riser 16 and the crosswise supporting ribs 22 are terminated short of the rearmost lengthwise rib 24. With this form of the step 12, the channel 20 of the lowermost step 12 is cut off and the lower edge of the riser 16 is placed on the floor of the lower level and the rearmost supporting rib 24 of this step 12 is inserted into the channel 20 of the next successive step 12 to form the stairway 10.

Figure 5:
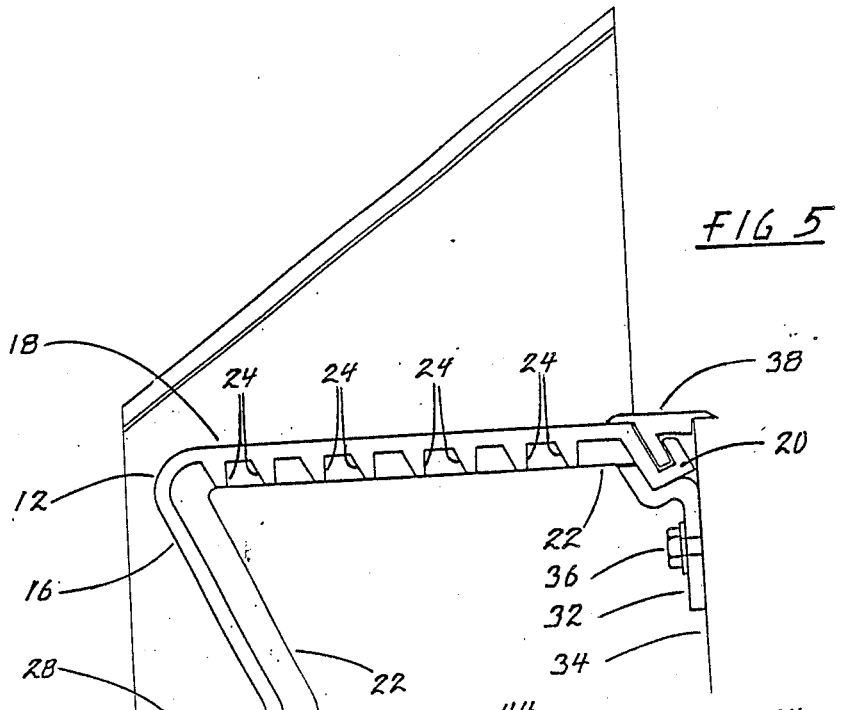
FIG. 5 is a vertical section through a further alternative form of the step of FIG. 2.
Figure 6:
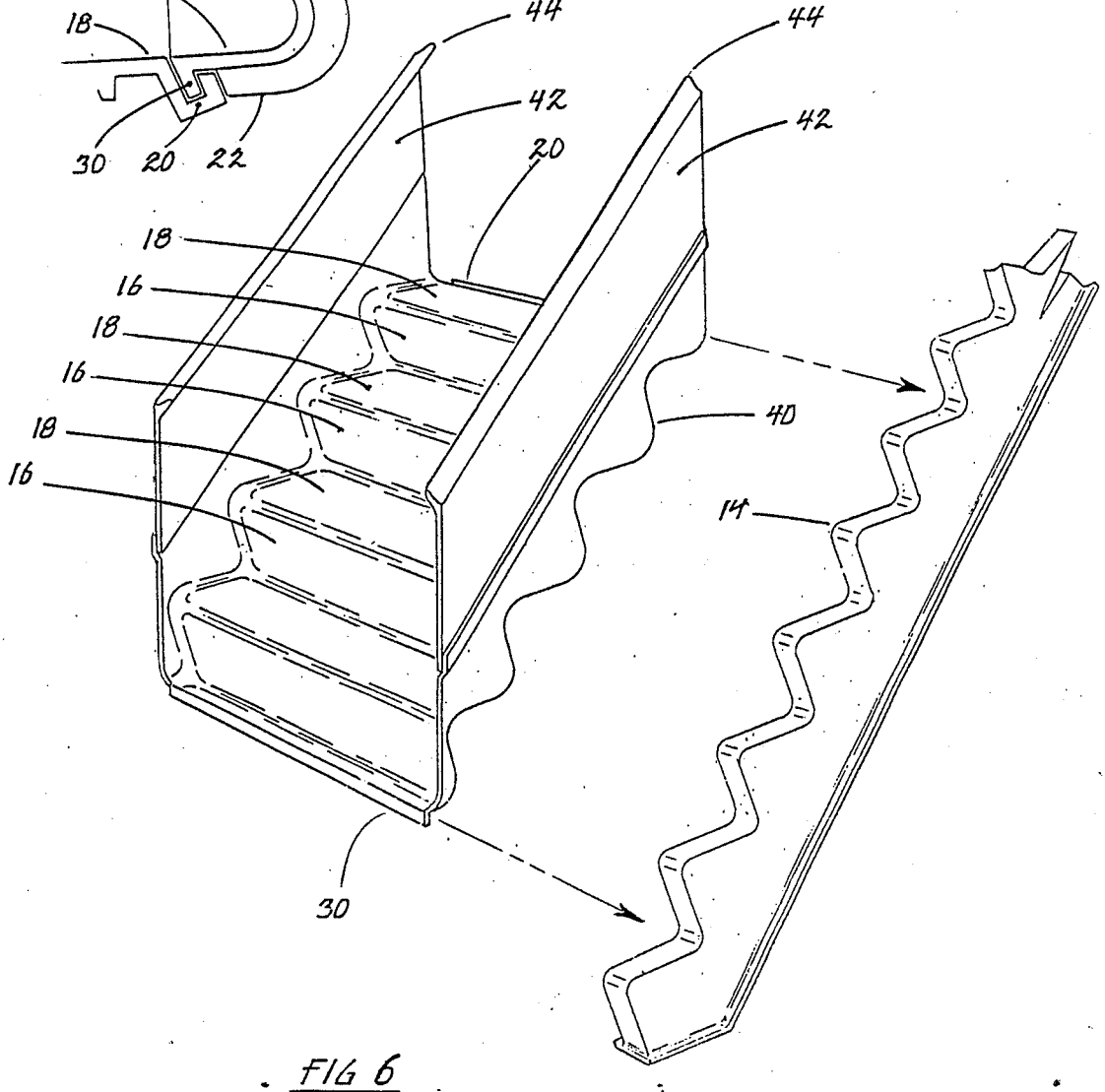
FIG. 6 is an isometric view showing another alternative form of the step of FIG. 2.

FIG. 5 shows another alternative form of the step 12. In this form, the riser 16 is inclined upwardly and forwardly and the lower portion 28 thereof is curved forwardly and terminates in a flange 30 which projects downwardly and readwardly from the lower end 28 of the riser 16. Also, the U-shaped channel 20 is provided at the rear edge of the tread portion 18 and extends downwardly and rearwardly so as to mate with the flange 30 of an adjacent step 12. In forming a stairway 10, the flange 30 of the lowermost step 12 is trimmed off to prevent the riser from being too high and the lower edge of the shortened riser 16 is placed on the floor of the lower level, while the flange 30 of each successive step 12 is inserted into the U-shaped channel 20 of the next lower step 12. At the upper level, a mounting bracket 32 is secured to the upper level floor support 34 by suitable means, such as bolt 36, and serves to engage and retain the U-shaped channel 20 of the uppermost step 12. Finally, a sill member 38 is inserted into the U-shaped channel 20 of the uppermost step 12 to cover the channel 20 and provide an aesthetic bridge between the stairway 10 and the upper level floor.

In FIGS. 1 through 5, the stairway 10 has been shown as being formed of a plurality of individual steps 12 which were preformed by injection molding. However, it will be apparent that additional time and labor can be saved by injection molding integral units containing three or four steps, as seen at 40 in FIG. 6. In this form of the present invention, the U-shaped channel 20 is provided only on the rear edge of the uppermost tread portion 18. In use, the flanges 26 of the unit 40 are placed on the stringers 14 and the unit 40 is secured in place by nailing through pre-molded nail holes formed in the flanges 26 into the stringers 14. A conventional thirteen step stairway 10 can be installed quickly and easily using various combinations of the multi-step units 40 together with individual steps 12, such as those of FIGS. 2, 4 and 5. Thus, for example, a thirteen step stairway 10 could be formed by using three four-step units 40 or four three-step units, not shown, and one step 12. Alternatively, the thirteen step stairway 10 could be formed by using three-step units 40 and one four-step unit 40. Obviously, if desired, fourteen step stairways could be similarly constructed. As noted above, considerable time and labor can be saved by installing a stairway 10 using individual injection molded steps 12. However, it will be obvious that even more time and labor can be saved by installing a stairway 10 using the multi-step units 40. Furthermore, the multi-step units 40 are especially desirable if it is desired to provide a stairway having a landing at some point. Thus, for example, a three-step unit 40 could be installed leading up to a landing and additional multi-step units 40 or preformed steps 12 could be installed to continue the stairway above the landing in the same or a different direction.

FIG. 7 shows a further alternative form of the present invention wherein wall panels 42 and a bannister 44 are injection molded as integral parts of the steps 12 or multi-step units 40. In this form of the present invention, the flanges 26 are omitted and the steps 12 or multi-step units 40 are installed by nailing through the wall panels 42 to the adjacent structure of the building. As noted above, the stairway 10 can be installed using individual preformed steps 12 or multi-step units 40 or any desired combination thereof. Also, if neccessary or desirable, a triangular filler member 31 may be provided to complete the stairway 10. The multi-step units 40 are installed by using self-tapping nails, screws or adhesive to secure the multi-step units 40 to the stringers 14.

Finally, if desired, the entire stairway 10 can be injection molded as an integral unit. If desired, the stringers 14 could also be injection molded as integral parts of the stairway unit 10. Due to the size of such one piece stairways, they are somewhat awkward for one person to install. However, it can be done and, even where more than one person is employed, it will be apparent that minimal time and labor will be required and very substantial cost savings can be realized.

Obviously numerous other variations and modifications can be made without departing from the spirit of the present invention. Therefore, it should be clearly understood that the forms of the present invention described above and shown in the figures of the accompanying drawings are illustrative only and are not intended to limit the scope of the present invention.

What is claimed is:

1. A prefabricated stairway having a plurality of preformed steps, each of said steps comprising:

a riser portion extending inclined upwardly and forwardly and having a lower portion which curves forwardly and has a flange projecting downwardly and rearwardly from the edge of said lower portion, a tread portion extending horizontally rearward from the upper edge of said riser portion, and a generally U-shaped channel extending along the rear edge of said tread portion and extending downwardly and rearwardly from said tread portion for mating with adjacent steps to form said stairway.

2. A prefabricated stairway having a plurality of preformed steps, each of said steps comprising:

a riser portion extending upward, a tread portion extending horizontally rearward from the upper edge of said riser portion, a generally U-shaped channel extending along one edge of said step for mating with adjacent steps to form said stairway, and an end panel joining said riser portion with said tread portion.

3. The stairway of claim 2 wherein:

said stairway is composed of at least one multi-step unit.

4. The stairway of claim 3 wherein: said multi-step unit includes three steps.

5. The stairway of claim 2 wherein: said composite material is carbon fiber.

6. The stairway of claim 2 wherein:

said step is composed of expanded polypropylene foam.

7. The stairway of claim 2 wherein:

said U-shaped channel is formed along the rear edge of said tread portion.

8. The stairway of claim 2 wherein:

said U-shaped channel extends along the lower edge of said riser portion.

9. The stairway of claim 2 wherein:

said step is formed of colored material.

10. The stairway of claim 3 further comprising:

an integral thirteen step unit.

11. The stairway of claim 10 wherein:

said integral unit is preformed at a factory and is delivered to the construction site in assembled form.

12. The stairway of claim 10 further comprising:

preformed stringers formed of, similar material as that of said stairway and extending lengthwise of said stairway and serving to provide support for said stairway.

13. The stairway of claim 12 wherein:

said stringers are formed integral with said stairway.

14. The stairway of claim 2 further comprising:

a flange projecting outwardly from the lower edge of said end panel extending diagonally from the rear end of said tread portion to the lower end of said riser portion.

15. The stairway of claim 2 further comprising:

a plurality of supporting ribs formed on the underside of said tread portion to reenforce said tread portion.

* * * * *